US006457316B1

(12) United States Patent
Czachor et al.

(10) Patent No.: US 6,457,316 B1
(45) Date of Patent: Oct. 1, 2002

(54) METHODS AND APPARATUS FOR SWIRLING FUEL WITHIN FUEL NOZZLES

(75) Inventors: Robert Paul Czachor, Cincinnati, OH (US); Claude Henry Chauvette, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 43 days.

(21) Appl. No.: 09/679,989

(22) Filed: Oct. 5, 2000

(51) Int. Cl.[7] ..... F02C 7/22
(52) U.S. Cl. ..... 60/776; 60/742
(58) Field of Search ..... 60/740, 742, 746, 60/776; 239/400

(56) References Cited

U.S. PATENT DOCUMENTS 3,980,233 A * 9/1976 Simmons et al. ..... 239/400
4,562,698 A * 1/1986 Halvorsen et al. ..... 60/742
4,600,151 A * 7/1986 Bradley ..... 239/400
4,638,636 A 1/1987 Cohen
4,666,368 A 5/1987 Hook, Jr. et al.
5,228,283 A * 7/1993 Sciocchetti ..... 60/742
5,252,026 A 10/1993 Shepherd
5,676,538 A 10/1997 Lovett
5,833,141 A 11/1998 Bechtel, II et al.
5,916,142 A * 6/1999 Snyder et al. ..... 60/740
6,070,411 A * 1/2000 Iwai et al. ..... 60/746
6,123,273 A 9/2000 Loprinzo et al.

* cited by examiner

*Primary Examiner*—Michael Koczo
(74) *Attorney, Agent, or Firm*—Nathan D. Herkamp; Armstrong Teasdale LLP

(57) ABSTRACT

Gas turbine engine fuel nozzles are illustrated which induce swirling to fuel flowing to the engine to facilitate reducing fuel coking. Each fuel nozzle includes an inlet, an outlet and a fuel delivery system extending therebetween. The fuel delivery system includes an inner fuel supply tube and an outer fuel supply tube. The inner fuel supply tube is concentrically aligned within the outer fuel supply tube and includes contoured fuel passageways and a center axis of symmetry. As fuel enters the contoured passageways, the fuel is accelerated locally and directed angularly with respect to the axis of symmetry.

20 Claims, 3 Drawing Sheets

METHODS AND APPARATUS FOR SWIRLING FUEL WITHIN FUEL NOZZLES

BACKGROUND OF THE INVENTION

This invention relates generally to fuel nozzles and, more particularly, to methods and apparatus for swirling fuel within fuel nozzles.

Gas turbine engines typically include a plurality of fuel nozzles for supplying fuel to the engine. Improving the life cycle of fuel nozzles installed within the turbine engine extends the longevity of the gas turbine engine. Known fuel nozzles include a delivery system and a support system. Each delivery system delivers fuel to the gas turbine engine and is supported and shielded within the gas turbine engine with the support system. The support system surrounds the delivery system and is thus subjected to higher temperatures than the delivery system which is cooled by the fluid flowing within the fuel nozzle.

Over time, continued exposure to high temperatures produced during gas turbine engine operation may induce thermal stresses on the fuel nozzles and/or facilitate fuel coking within the fuel nozzle. Fuel coking within the nozzle may cause fuel flow reductions and excessive fuel maldistribution within the gas turbine engine, which in-turn may result in turbine inefficiency, turbine component distress,, and reduced engine exhaust gas temperature margin.

To facilitate reducing the effects of the high temperatures, known fuel nozzles include thermal insulation mechanisms, and operate with high fuel flow rates to keep wetted surface temperatures below levels where coking can occur. Known thermal insulation mechanisms include external heat shields, and internal insulating cavities and heat shields which isolate fuel supply tubes from nozzle housing. Such insulation mechanisms add complexity to the fuel nozzle.

To further minimize the effects of high temperatures, during low power operations when high fuel flow rates are not demanded, dribble fuel is supplied to the fuel nozzles. The dribble fuel removes thermal energy from the delivery system that was induced from thermal soak-back of heat stored within the fuel nozzle support system. The additional fuel supplied as dribble fuel to the fuel nozzles may reduce turbine efficiency.

BRIEF SUMMARY OF THE INVENTION

In an exemplary embodiment, gas turbine engine fuel nozzles induce swirling to fuel flowing within the nozzles to facilitate a reduction in fuel coking. Each fuel nozzle includes an inlet, an outlet and a fuel delivery system extending therebetween. The fuel delivery system includes an inner fuel delivery tube and an outer fuel supply tube. The inner fuel supply tube is concentrically aligned within the outer fuel supply tube and includes contoured fuel passageways and a center axis of symmetry.

In use, fuel enters the fuel nozzle inlet and flows towards the contoured fuel passageways. As fuel enters the contoured passageways, the fuel is accelerated locally, and directed angularly with respect to the center axis of symmetry. The contoured passageways impart swirling on the fuel to produce a turbulated fuelflow downstream from the contoured passageways. The turbulated fuelflow facilitates reducing wetted wall temperatures downstream from the contoured passageway, thus lowering operating temperatures of the fuel nozzle. Lowering fuel nozzle operating temperatures facilitates reducing fuel coking within the fuel nozzle, regardless of the fuel flow rate through the fuel nozzle. As a result, the contoured fuel passageways facilitate reducing fuel coking within the gas turbine engine fuel nozzle.

DETAILED DESCRIPTION OF THE INVENTION

Figure 1:
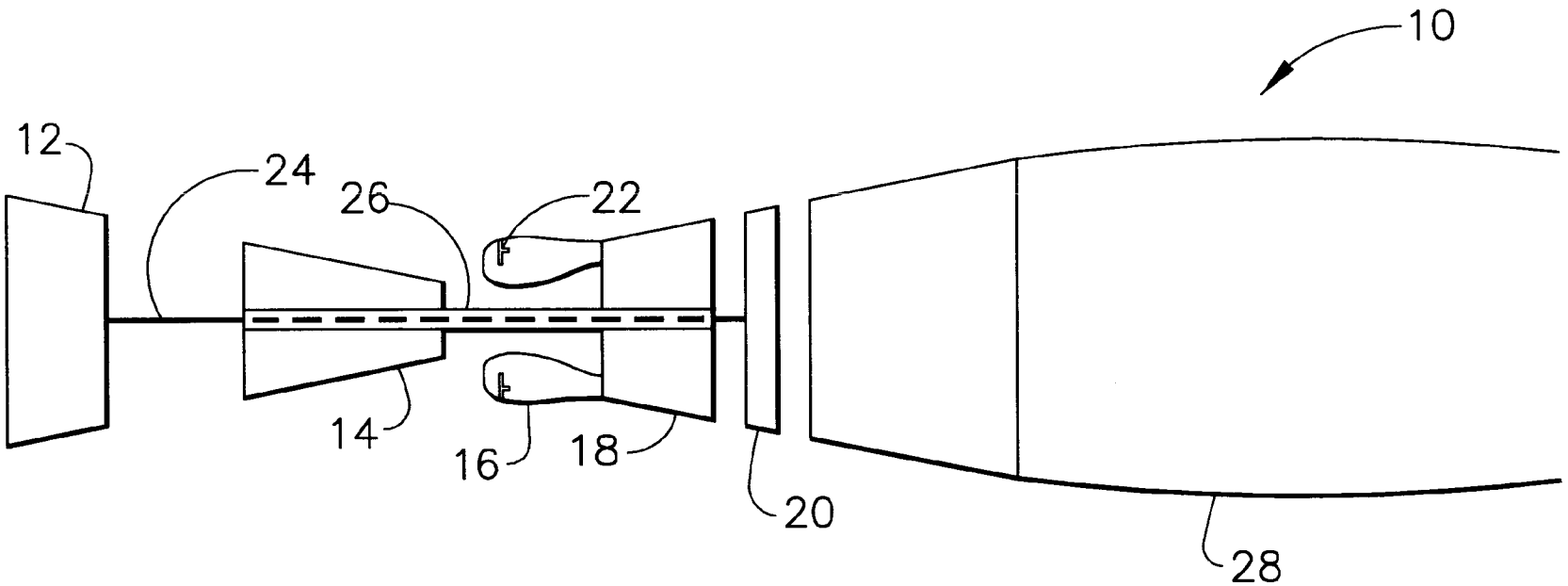
FIG. 1 is a schematic illustration of a gas turbine engine.

FIG. 1 is a schematic illustration of a gas turbine engine 10 including a low pressure compressor 12, a high pressure compressor 14, and a combustor 16. In one embodiment, engine 10 is a GE90 engine available from General Electric Company, Cincinnati, Ohio. Engine 10 also includes a high pressure turbine 18 and a low pressure turbine 20. In one embodiment, combustor 16 is a dual annular combustor that includes two radially stacked mixers (not shown) for each fuel nozzle 22, which appear as two annular rings when viewed from the front of combustor 16. Compressor 12 and turbine 20 are coupled by a first shaft 24, and compressor 14 and turbine 18 are coupled by a second shaft 26. A load (not shown) is also coupled to gas turbine engine 10 with first shaft 24.

In operation, air flows through low pressure compressor 12 and compressed air is supplied from low pressure compressor 12 to high pressure compressor 14. The highly compressed air is delivered to combustor 16. Airflow from combustor 16 drives rotating turbines 18 and 20 and exits gas turbine engine 10 through a nozzle 28.

Figure 2:
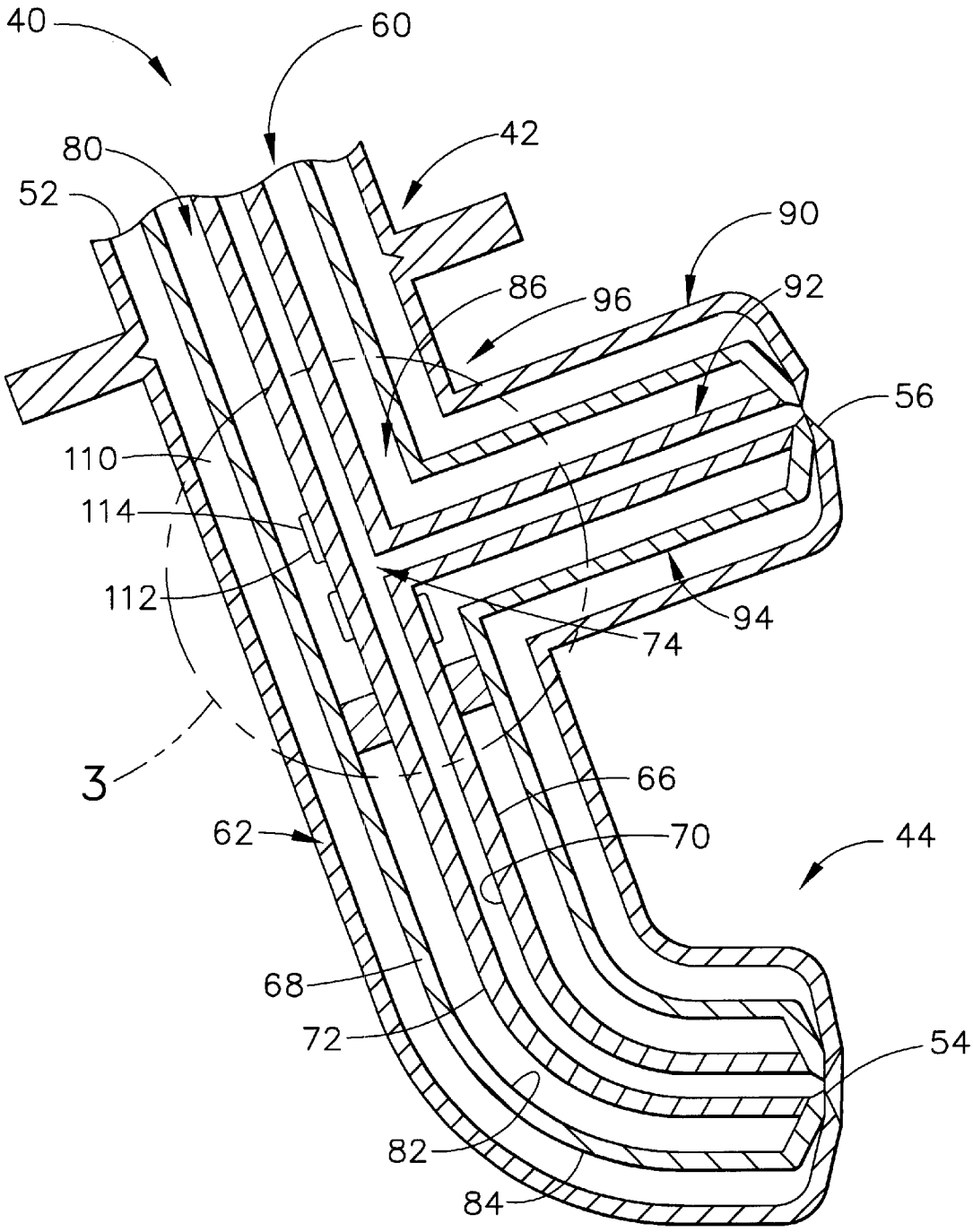
FIG. 2 is a side schematic view of one embodiment of a fuel nozzle that could be used in conjunction with the gas turbine engine shown in FIG. 1.
Figure 3:
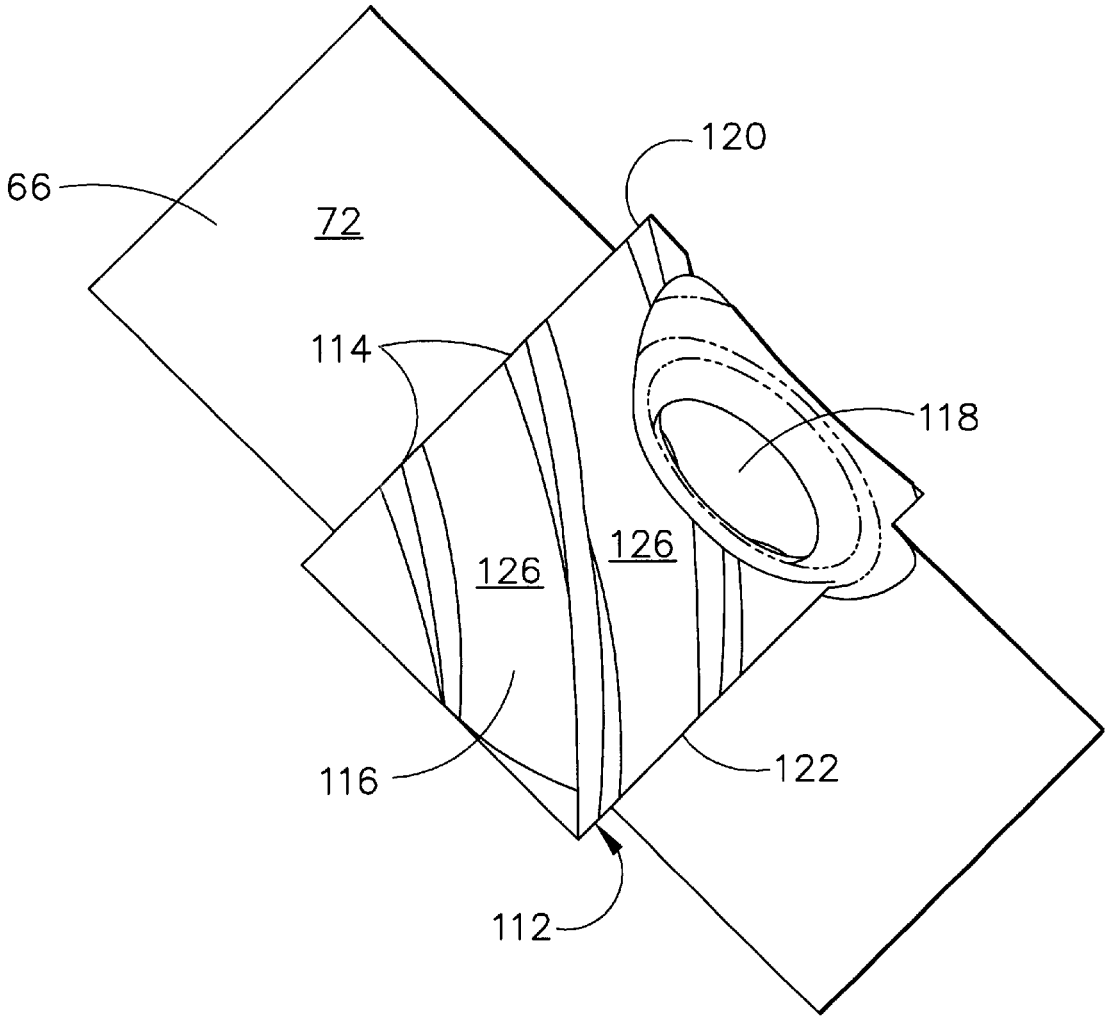
FIG. 3 is a side perspective view of a portion of the fuel nozzle shown in FIG. 2 taken along area 3.

FIG. 2 is a side schematic view of an exemplary embodiment of a fuel nozzle 40 that could be used a gas turbine engine, such as turbine. engine 10 (shown in FIG. 1). FIG. 3 is a side perspective view of fuel nozzle 40 taken along area 3. More specifically, FIGS. 2 and 3 illustrate an exemplary embodiment of fuel nozzle 22 (shown in FIG. 1) that could be used with a dual annular combustor 16 (shown in FIG. 1). In the exemplary embodiment, dual annular combustor 16 includes two radially stacked mixers (not shown) for each fuel nozzle which appear as two annular rings when viewed from the front of the combustor. In an alternative embodiment, fuel nozzle 40 is any fuel nozzle used to supply fuel to a gas turbine engine.

A plurality of fuel nozzles 40, each including a first end 42 and a second end 44, are spaced circumferentially around the gas turbine engine to supply fuel to the gas turbine engine. Each fuel nozzle 40 also includes an inlet 52 that is adjacent fuel nozzle first end 42, a first fuel outlet 54 that is adjacent fuel nozzle second end 44, a second fuel outlet 56, a fuel delivery system 60, and a support system 62.

Fuel delivery system 60 extends between fuel nozzle inlet 52 and fuel outlets 54 and 56, and includes an inner fuel supply tube 66 and an outer fuel supply tube 68. Inner fuel supply tube 66 extends from fuel nozzle inlet 52 within outer fuel supply tube 68, such that inner fuel supply tube 66 is radially inward from and concentrically aligned with respect to outer fuel supply tube 68. Inner fuel supply tube 66 is hollow and includes an inner surface 70, an outer surface 72, and an opening 74 extending therebetween. In the exemplary embodiment, inner fuel supply tube 66 has a substantially circular cross-sectional profile.

Outer fuel supply tube 68 circumferentially surrounds inner fuel supply tube 66 such that a chamber 80 is defined between inner and outer fuel supply tubes 66 and 68, respectively. Outer fuel supply tube 68 includes an inner surface 82, an outer surface 84, and an opening 86 extending therebetween. In the exemplary embodiment, outer fuel supply tube 68 has a substantially circular cross-sectional profile.

A secondary fuel tube assembly 90 is in flow communication with fuel delivery system 60 and extends from fuel nozzle 40 between fuel nozzle inlet 52 and fuel nozzle first fuel outlet 54. In one embodiment, fuel nozzle 54 is known as an outer tip fuel nozzle. More specifically, secondary fuel tube assembly 90 includes an inner tube 92 and an outer tube 94 that are in flow communication with respective inner and outer fuel supply tubes 66 and 68. Inner and outer tubes 92 and 94, respectively, connect to fuel nozzle 40 with a T-connection 96 such that each tube 92 and 94 extends substantially perpendicularly from fuel supply tubes 66 and 68 to fuel nozzle second fuel outlet 56. Secondary fuel tube assembly inner fuel tube 92 is concentric with respect to secondary fuel tube assembly outer fuel tube 94. In an alternative embodiment, fuel nozzle 40 does not include secondary fuel tube assembly 90.

Inner and outer fuel supply tubes 66 and 68, respectively, are aligned such that inner fuel supply tube opening 74 and outer fuel supply tube opening 86 are concentrically aligned within T-connection 96. Accordingly, secondary fuel assembly 90 extends through fuel supply tube openings 74 and 86 to couple with fuel delivery system 60.

Support system 62 extends between fuel nozzle first end 42 and fuel nozzle second end 44 to structurally support fuel nozzle delivery system 60 and shield fuel nozzle delivery system 60 from hot gases exiting a compressor, similar to compressor 14 (shown in FIG. 1). More specifically, support system 62 extends circumferentially around fuel delivery system 60 such that an insulating cavity 110 is defined between support system 62 and fuel delivery system 60. Insulating cavity 110 may contain any of the following: air, fuel, coked fuel, or other insulating materials.

Insulating cavity 110 circumferentially surrounds fuel delivery system chamber 80 and extends from fuel nozzle first end 42 to fuel nozzle second end 44. Insulating cavity 110 is defined between support system 62 and delivery system 60 and thermally insulates delivery system 60 from support system 62. Because insulating cavity 110 thermally insulates delivery system 60 and because fluid flow within fuel delivery system chamber 80 helps to cool fuel delivery system 60, support system 62 is subjected to higher temperatures than delivery system 60.

An annular swirler 112 extends circumferentially around fuel delivery inner tube 66 and includes a plurality of vanes 114 extending radially outward from an outer surface 116, and an opening 118. More specifically, swirler 112 extends around fuel delivery inner tube 66 at T-connection 96. In one embodiment, annular swirler 112 is formed integrally with inner fuel supply tube 66. In an alternative embodiment, fuel nozzle 40 does not include annular swirler 112, but rather vanes 114 extend radially outward from inner fuel supply tube outer surface 72. Accordingly, opening 118 is aligned concentrically with respect to inner fuel supply tube opening 74.

Swirler vanes 114 extend radially outward from swirler outer surface. 116 and extend across swirler outer surface 116 between a first side 120 and a second side 122 of swirler 112. Vanes 114 are aligned angularly with respect to a center axis of symmetry (not shown) of swirler 112, such that vanes 114 are not parallel with respect to the center axis of symmetry, but vanes 114 are substantially parallel with respect to each other. Adjacent vanes 114 define a contoured fuel passageway 126 therebetween to turn fuel flowing through fuel nozzle 40. In an alternative embodiment, vanes 114 extend radially inward from outer fuel supply tube inner surface 82 towards inner fuel delivery outer surface 70.

In use, fuel supplied from a fuel source (not shown) enters fuel nozzles 40 through each fuel nozzle inlet 52. Fuel flowing towards T-connection 96 through fuel nozzle delivery system 60 flows within fuel delivery chamber 80. As fuel enters T-connection 96, swirler vanes 114 redirect fuel to flow angularly with respect to the swirler center axis of symmetry. More specifically, fuel flowing through swirler 112 is accelerated locally within T-connection 96, and vanes 114 impart swirling on the fuel that results in a turbulated fuelflow downstream from swirler 112.

The swirl velocity induced by vanes 114 increases a convection coefficient for several tube diameters downstream from swirler 112 through second tube assembly 90 towards second fuel outlet 56. The increased convection coefficient facilitates a reduction in fuel wetted wall temperatures downstream from swirler 112, thus lowering operating temperatures of fuel nozzle 40 and facilitating a reduction in fuel coking within fuel nozzle 40. In particular, during low fuel flowrate operating conditions, i.e., flowrates less than approximately 10 pph, the augmented convection coefficient decreases wetted wall temperatures despite the low fuel flowrate. Furthermore, because fuel nozzles 40 operate with lower operating temperatures, turbine engine exhaust gas temperatures are lowered and turbine efficiency is maintained.

The above-described gas turbine engine fuel nozzle is cost-effective and highly reliable. The fuel nozzle includes a swirler that induces swirling on the fuel flowing through the fuel nozzle. The induced swirling produces turbulated fuelflow downstream from the swirler that facilitates an increase in the fuel convection coefficient. As a result of the augmented convection coefficient, wetted wall temperatures downstream from swirler are lowered, thus facilitating a reduction in the operating temperature of the fuel nozzle. As a result, the swirler facilitates a reduction in fuel coking within the fuel nozzle in a cost-effective and reliable manner.

While the invention has been described in terms of various specific embodiments, those skilled in the art will recognize that the invention can be practiced with modification within the spirit and scope of the claims.

What is claimed is:

1. A method for supplying fuel to a gas turbine engine to facilitate reducing fuel coking within a fuel nozzle, the fuel nozzle including an inlet, a first discharge nozzle, a second discharge nozzle between the first discharge nozzle and the inlet such that the second discharge nozzle discharges fuel upstream from the first discharge nozzle, and a first fuel supply tube, said method comprising the steps of:

supplying fuel to the first fuel supply tube through the fuel nozzle inlet;

swirling fuel within the fuel nozzle by channeling the fuel through at least one vane; and channeling the swirling fuel to at least one of the first discharge nozzle and the second discharge nozzle.

2. A method in accordance with claim 1 wherein said step of swirling fuel further comprises the step of using a contoured fuel passageway to swirl the fuel within the fuel nozzle.

3. A method in accordance with claim 1 when e nozzle also includes an outer fuel supply tube, the first fuel supply tube housed concentrically within the outer fuel supply tube, said step of swirling fuel further comprises the step channeling fuel through a plurality of vanes that extend radially inward from an inner surface of the outer fuel supply tube towards an outer surface of the first fuel supply tube.

4. A method in accordance with claim 1 wherein the fuel nozzle also includes an outer fuel supply tube, the first fuel supply tube housed concentrically within the outer fuel supply tube, said step of swirling fuel further comprises the step of channeling fuel through a plurality of vanes that extend radially outward from an outer surface of the first fuel supply tube towards an inner surface of the outer fuel supply tube.

5. A method in accordance with claim 1 wherein step of swirling fuel further comprises the step of channeling fuel through an annular swirler attached circumferentially around the first fuel supply tube, such that a plurality of vanes extend radially outward from the inner fuel supply tube and induce swirling within the fuel.

6. A fuel nozzle for a gas turbine engine, said fuel nozzle comprising:

an inlet;

a first discharge nozzle;

a second discharge nozzle between said inlet and said first discharge nozzle; and a fuel delivery system comprising a first fuel supply tube, said fuel supply tube extending between said fuel nozzle inlet and said first discharge nozzle, said fuel delivery system further comprising at least one vane configured to impart swirling to fluid flowing to at least one of said first and said second discharge nozzle through said fuel nozzle.

7. A fuel nozzle in accordance with claim 6 wherein said fuel supply tube comprises a contoured fuel passageway configured to impart swirling to fluid flowing through said fuel nozzle.

8. A fuel nozzle in accordance with claim 6 wherein said fuel delivery system further comprises an annular swirler concentric with said first fuel supply tube and configured to impart swirling to fluid flowing through said fuel nozzle.

9. A fuel nozzle in accordance with claim 8 wherein said swirler comprises a plurality of vanes and an outer surface, said vanes extending radially outward from said swirler outer surface.

10. A fuel nozzle in accordance with claim 8 wherein said seed discharge nozzle in flow communication with said fuel delivery system and configured to discharge swirling fuel therefrom.

11. A fuel nozzle in accordance with claim 10 wherein said second discharge nozzle extends radially outward from said swirler.

12. A fuel nozzle in accordance with claim 6 wherein said fuel delivery system further comprises an outer fuel supply tube extending circumferentially around said first fuel supply tube, said first fuel supply tube concentric with respect to said outer fuel supply tube.

13. A fuel nozzle in accordance with claim 12 wherein said outer fuel supply tube further comprises an inner surface and an outer surface, said outer fuel supply tube inner surface comprises a plurality of vanes extending radially inward from said inner surface and configured to impart swirling to fluid flowing through said fuel nozzle.

14. A gas turbine engine comprising at least one fuel nozzle configured to supply fuel to said gas turbine engine, said fuel nozzle comprising an inlet, a first outlet and a second outlet, and a fuel delivery system, said fuel delivery system comprising a first fuel supply tube, said fuel supply tube extending between said fuel nozzle inlet and said fuel nozzle first outlet, said fuel nozzle further comprising at least one vane configured to swirl fuel flowing to at least one of said first outlet and said second outlet through said fuel nozzle, said second outlet for discharging fuel from said nozzle upstream from said first outlet.

15. A gas turbine engine in accordance with claim 14 wherein said fuel nozzle fuel supply tube comprises a fuel passageway contoured to swirl fuel flowing through said fuel nozzle.

16. A gas turbine engine in accordance with claim 14 wherein said fuel nozzle fuel delivery system further comprises an outer fuel supply tube, said first fuel supply tube radially inward from said outer fuel supply tube and concentric with said outer fuel supply tube, at least one of said outer and first fuel supply tubes comprising a plurality of vanes configured to swirl fuel flowing through said fuel nozzle.

17. A gas turbine engine in accordance with claim 16 wherein said fuel delivery system outer fuel supply tube comprises an inner surface and an outer surface, said inner surface comprises a plurality of vanes extending radially inward towards said first fuel supply tube.

18. A gas turbine engine in accordance with claim 16 wherein said fuel delivery system inner fuel supply tube comprises an outer surface and an inner surface, said outer surface comprises a plurality of vanes extending radially outward towards said outer fuel supply tube.

19. A gas turbine engine in accordance with claim 14 wherein said fuel nozzle fuel delivery system further comprises an annular swirler concentric with said first fuel supply tube and configured to swirl fuel flowing through said fuel nozzle.

20. A gas turbine engine in accordance with claim 19 wherein said second outlet extends outward from said swirler.

* * * * *

UNITED STATES PATENT AND TRADEMARK OFFICE

CERTIFICATE OF CORRECTION

PATENT NO. : 6,457,316 B1
DATED : October 1, 2002
INVENTOR(S) : Czachor et al.

It is certified that error appears in the above-identified patent and that said Letters Patent is hereby corrected as shown below:

Column 5,
Line 1, delete “when e” and insert therefor -- wherein the fuel --.
Line 49, delete “seed” and insert therefor -- second --.

Signed and Sealed this

Second Day of November, 2004

JON W. DUDAS
*Director of the United States Patent and Trademark Office*